US011168434B2

(12) United States Patent
Leibman et al.

(10) Patent No.: US 11,168,434 B2
(45) Date of Patent: Nov. 9, 2021

(54) VALVE MANIFOLD WITH AUXILIARY INLET FOR A WASHING MACHINE APPLIANCE

(71) Applicant: Haier US Appliance Solutions, Inc., Wilmington, DE (US)

(72) Inventors: Alexander B. Leibman, Prospect, KY (US); Michael Glenn Mattingly, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 187 days.

(21) Appl. No.: 16/254,768

(22) Filed: Jan. 23, 2019

(65) Prior Publication Data

US 2020/0232152 A1 Jul. 23, 2020

(51) Int. Cl.
*D06F 39/08* (2006.01)

(52) U.S. Cl.
CPC ..... *D06F 39/088* (2013.01)

(58) Field of Classification Search
CPC ..... D06F 39/088
See application file for complete search history.

(56) References Cited

U.S. PATENT DOCUMENTS

| | | | |
|---|---|---|---|
| 1,897,953 A | 2/1933 | Dehle | |
| 2,504,013 A | 4/1950 | Ellis | |
| 2,858,688 A | 11/1958 | Smith | |
| 4,903,508 A | 2/1990 | Durazzani et al. | |
| 6,143,257 A | 11/2000 | Spriggs et al. | |
| 7,421,752 B2 | 9/2008 | Donadon et al. | |
| 2006/0107468 A1 | 5/2006 | Urbanet et al. | |
| 2012/0151970 A1* | 6/2012 | Leibman | D06F 39/00 68/17 R |
| 2017/0306552 A1 | 10/2017 | Leibman et al. | |

FOREIGN PATENT DOCUMENTS

| | | | |
|---|---|---|---|
| CN | 1133368 | A | 10/1996 |
| CN | 101768889 | A | 7/2010 |
| CN | 203977128 | U | 12/2014 |
| CN | 205613148 | U | 10/2016 |
| EP | 0300295 | A1 | 1/1989 |
| EP | 1295980 | A1 | 3/2003 |
| EP | 1595991 | A1 | 11/2005 |
| EP | 1600546 | A1 | 11/2005 |
| EP | 1785518 | A1 | 5/2007 |
| EP | 3153621 | A1 | 4/2017 |
| KR | 100614185 | B1 | 8/2006 |
| KR | 101364547 | B1 | 2/2014 |
| WO | WO2004106617 | A1 | 12/2004 |

* cited by examiner

*Primary Examiner* — Jason Y Ko
(74) *Attorney, Agent, or Firm* — Dority & Manning, P.A.

(57) ABSTRACT

A washing machine appliance includes a cabinet, a tub, and a basket. The washing machine appliance further includes a valve manifold. The valve manifold includes a first inlet port configured to fluidly connect to a first water source, a second inlet port configured to fluidly connect to a second water source, and an auxiliary inlet port configured to fluidly connect to an auxiliary fluid source. The valve manifold also includes an auxiliary outlet port downstream of the auxiliary inlet port and an auxiliary valve downstream of the first inlet port and the second inlet port and upstream of the auxiliary inlet. The auxiliary valve is configured to selectively provide fluid communication from the auxiliary inlet and at least one of the first inlet port and the second inlet port to the auxiliary outlet port.

20 Claims, 6 Drawing Sheets

VALVE MANIFOLD WITH AUXILIARY INLET FOR A WASHING MACHINE APPLIANCE

FIELD OF THE INVENTION

The present disclosure relates generally to washing machine appliances, and more particularly to valve manifolds for washing machine appliances.

BACKGROUND OF THE INVENTION

Washing machine appliances generally include a tub for containing wash fluid, e.g., water and detergent, bleach, and/or other fluid additives. A basket is rotatably mounted within the tub and defines a wash chamber for receipt of articles for washing. During operation of such washing machine appliances, wash fluid is directed into the tub and onto articles within the wash chamber of the basket. The basket and/or an agitation element can rotate at various speeds to, e.g., agitate articles within the wash chamber, wring wash fluid from articles within the wash chamber, etc.

The wash fluid may include a variety of fluid additives (in addition to water) to assist with washing and rinsing a load of articles. For example, detergents and/or stain removers may be added during wash and prewash cycles of washing machine appliances. As another example, fabric softeners may be added during rinse cycles of washing machine appliances.

Fluid additives are preferably introduced at an appropriate time during the operation of washing machine appliance and in a proper volume. By way of example, adding insufficient volumes of either the detergent or the fabric softener to the laundry load can negatively affect washing machine appliance operations by diminishing efficacy of a cleaning operation. Similarly, adding excessive volumes of either the detergent or the fabric softener can also negatively affect washing machine appliance operations by diminishing efficacy of a cleaning operation.

For instance, when too much detergent is added during a wash cycle, detergent can remain in articles after a rinse cycle because the rinse cycle may not be able to remove all of the detergent from the articles. Unremoved detergent can cause graying within such articles as the detergent builds up over time, can contribute to a roughness feeling of such articles, and can trigger skin allergies. The unremoved detergent can also negatively affect the efficacy of fabric softener during the rinse cycle. Further, unremoved detergent can also cause excess suds that can damage the washing machine and/or decrease a spin speed of the washing machine appliance's drum thereby causing articles therein to retain excessive liquids.

Water may enter the washing machine appliance via a valve or manifold. Wash fluid may then be generated by mixing the water with one or more fluid additives, e.g., from a dispenser cup or tray or a bulk tank within the washing machine appliance. Such arrangements generally require a portion of the limited space within the washing machine appliance to be occupied by the additive storage mechanisms, such as the bulk tank. Additionally, such arrangements require multiple valves and tubing or other conduits in addition to the water manifold to handle the fluid additive (s).

Accordingly, a washing machine appliance including one or more features for integrated handling of water and fluid additives would be useful. Further, a washing machine appliance including one more features for automatic dispensing of fluid additives without taking up limited space within the washing machine appliance, e.g., fluid additives from an external source, would be beneficial.

BRIEF DESCRIPTION OF THE INVENTION

Aspects and advantages of the invention are set forth below in the following description, or may be obvious from the description, or may be learned through practice of the invention.

In accordance with one embodiment of the present disclosure, a washing machine appliance is provided. The washing machine appliance includes a cabinet and a tub positioned within the cabinet. A basket is rotatably mounted within the tub. The basket defines a wash chamber for receipt of articles for washing. The washing machine appliance further includes a valve manifold. The valve manifold includes a first inlet port configured to fluidly connect to a first water source, a second inlet port configured to fluidly connect to a second water source, and an auxiliary inlet port configured to fluidly connect to an auxiliary fluid source. The valve manifold also includes an auxiliary outlet port downstream of the auxiliary inlet port and an auxiliary valve downstream of the first inlet port and the second inlet port and upstream of the auxiliary inlet. The auxiliary valve is configured to selectively provide fluid communication from the auxiliary inlet and at least one of the first inlet port and the second inlet port to the auxiliary outlet port.

In accordance with another embodiment of the present disclosure, a valve manifold for a washing machine appliance is provided. The valve manifold includes a first inlet port configured to fluidly connect to a first water source, a second inlet port configured to fluidly connect to a second water source, and an auxiliary inlet port configured to fluidly connect to an auxiliary fluid source. The valve manifold also includes an auxiliary outlet port downstream of the auxiliary inlet port and an auxiliary valve downstream of the first inlet port and the second inlet port and upstream of the auxiliary inlet. The auxiliary valve is configured to selectively provide fluid communication from the auxiliary inlet and at least one of the first inlet port and the second inlet port to the auxiliary outlet port.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
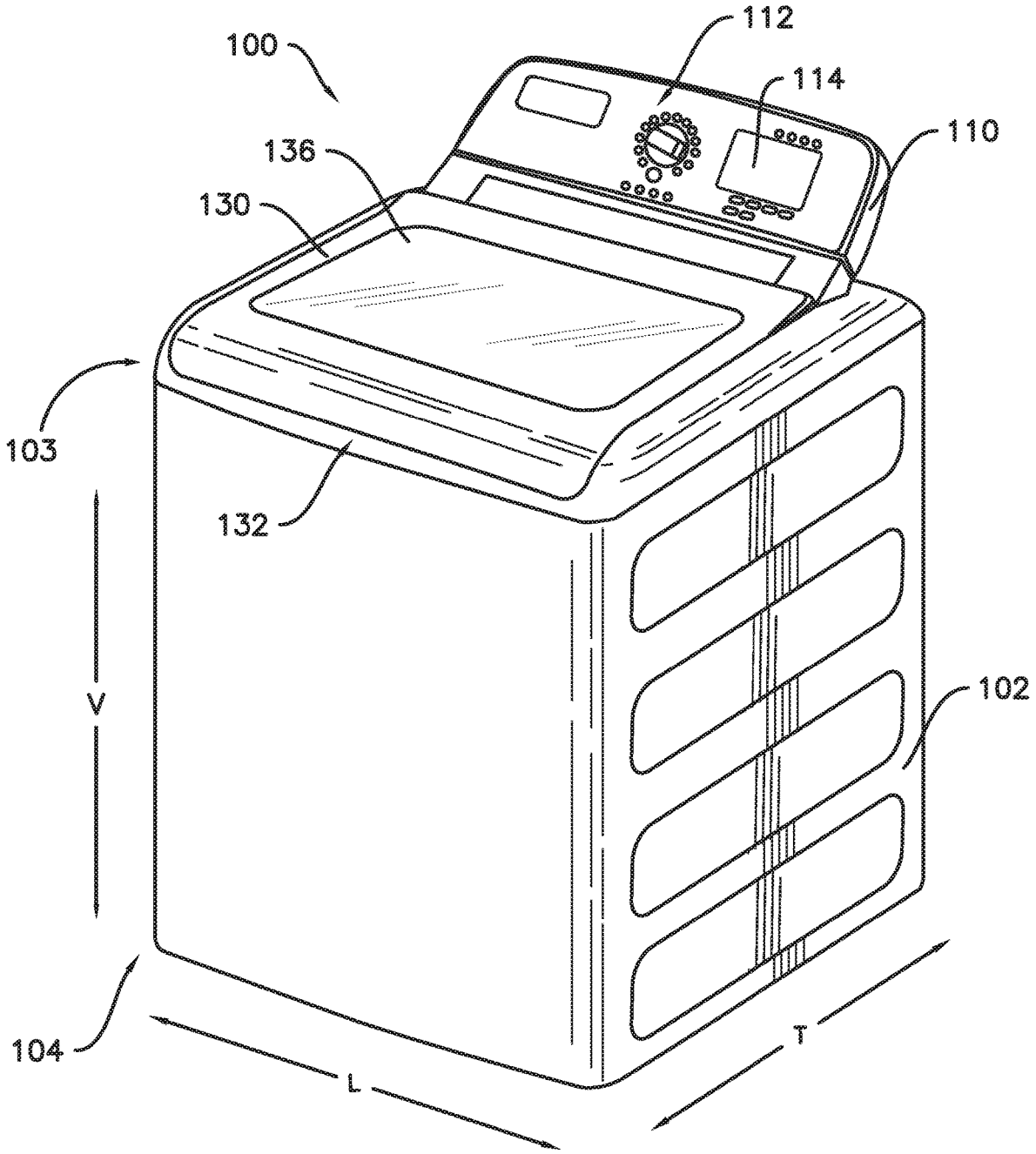
FIG. 1 provides a perspective view of an exemplary washing machine appliance that may incorporate various embodiments of the present subject matter with a door or lid of the washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Repeat use of reference characters in the present specification and drawings is intended to represent the same or analogous features or elements of the present disclosure.

In order to aid understanding of this disclosure, several terms are defined below. The defined terms are understood to have meanings commonly recognized by persons of ordinary skill in the arts relevant to the present invention. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one element from another and are not intended to signify location or importance of the individual elements. Furthermore, it should be appreciated that as used herein, terms of approximation, such as "approximately," "substantially," or "about," refer to being within a ten percent margin of error. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
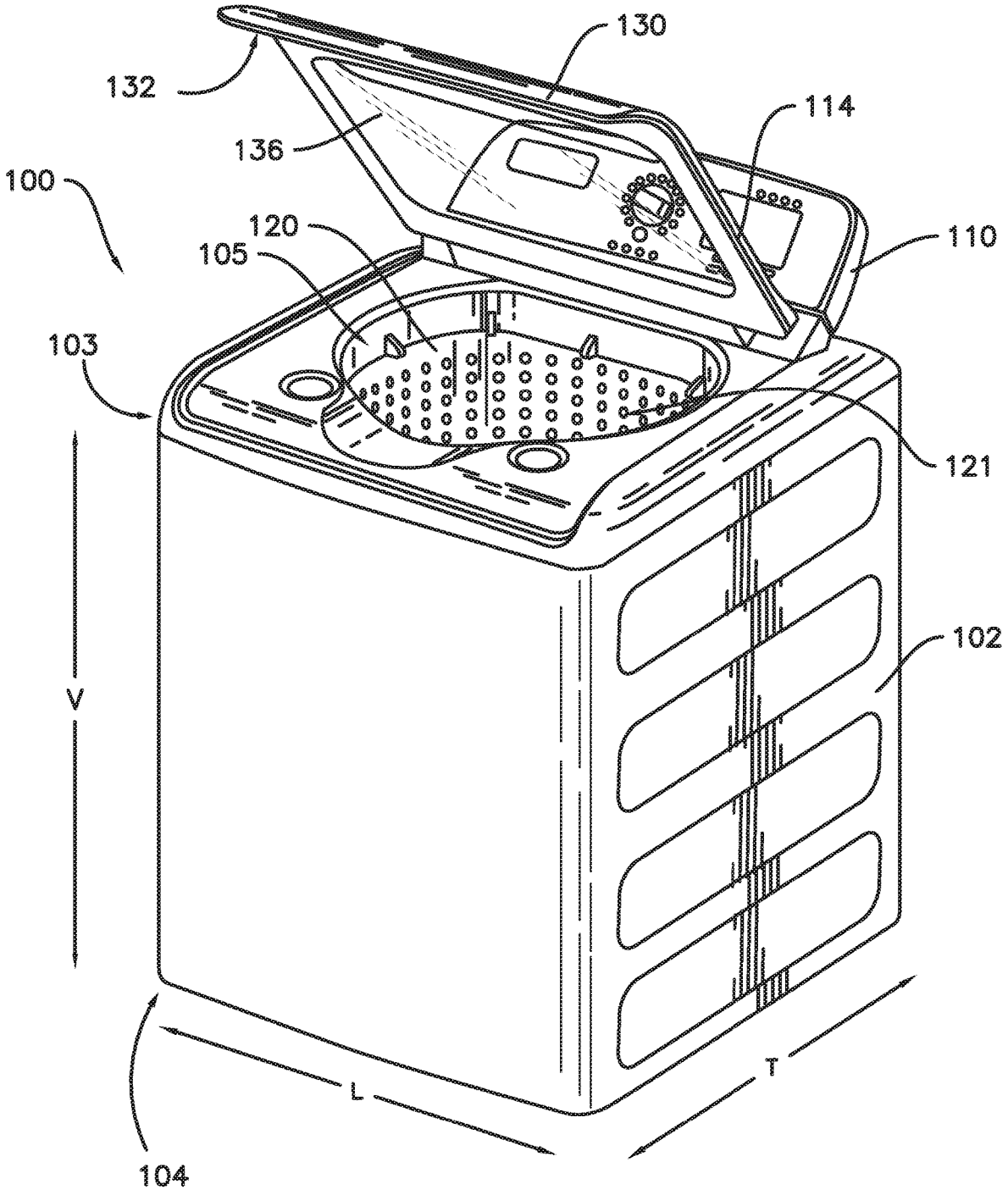
FIG. 2 provides a perspective view of the exemplary washing machine appliance of FIG. 1 with the door or lid of the washing machine appliance shown in an open position.

FIGS. 1 and 2 illustrate perspective views of an exemplary embodiment of a vertical axis washing machine appliance 100. In FIG. 1, a lid or door 130 is shown in a closed position. In FIG. 2, the door 130 is shown in an open position. While described in the context of a specific embodiment of vertical axis washing machine appliance 100, it will be understood that vertical axis washing machine appliance 100 is provided by way of example only. Other washing machine appliances having different configurations, different appearances, and/or different features may also be utilized with the present subject matter as well, e.g., horizontal axis washing machines.

Washing machine appliance 100 defines a lateral direction L, a transverse direction T, and a vertical direction V. The lateral direction L, transverse direction T, and vertical direction V are mutually perpendicular and define an orthogonal coordinate system. As shown, washing machine appliance 100 has a cabinet 102 which extends between a top 103 and a bottom 104 along the vertical direction V. A wash basket 120 (FIG. 2) is rotatably mounted within cabinet 102. For example, a wash tub 124 (FIG. 3) may be mounted within the cabinet 102, as described in more detail below, and the wash basket 120 may be rotatably mounted within the wash tub 124. A motor 122 (FIG. 3) is in mechanical communication with wash basket 120 in order to selectively rotate wash basket 120 (e.g., during an agitation or a rinse cycle of washing machine appliance 100). Wash basket 120 defines a wash chamber 121 (FIG. 2) that is configured for receipt of articles for washing. An agitator or impeller extends from wash basket 120 into wash chamber 121 to assist agitation of articles disposed within wash chamber 121 during operation of washing machine appliance 100.

Cabinet 102 of washing machine appliance 100 has an aperture 105 (FIG. 2) that permits user access to wash chamber 121 of wash basket 120. In the illustrated example, the aperture 105 is defined in a top panel of the cabinet 102, however, this is by way of example only, the aperture 105 may also be defined, e.g., in a front panel of the cabinet 102. Door 130 is rotatably mounted to cabinet 102. Door 130 selectively rotates between the closed position shown in FIG. 1 and the open position shown in FIG. 2. In the closed position, door 130 inhibits access to wash chamber 121. Conversely, in the open position, a user can access wash chamber 121. A window 136 in door 130 permits viewing of wash chamber 121 when door 130 is in the closed position, e.g., during operation of washing machine appliance 100. Door 130 also includes a handle 132 that, e.g., a user may pull and/or lift when opening and closing door 130.

A control panel 110 with a plurality of input selectors 112 (FIG. 1) extends from the cabinet 102. Control panel 110 and input selectors 112 collectively form a user interface for operator selection of machine cycles and features. A display 114 of control panel 130 may indicate selected features, a countdown timer, and/or other items of interest to appliance users.

Figure 3:
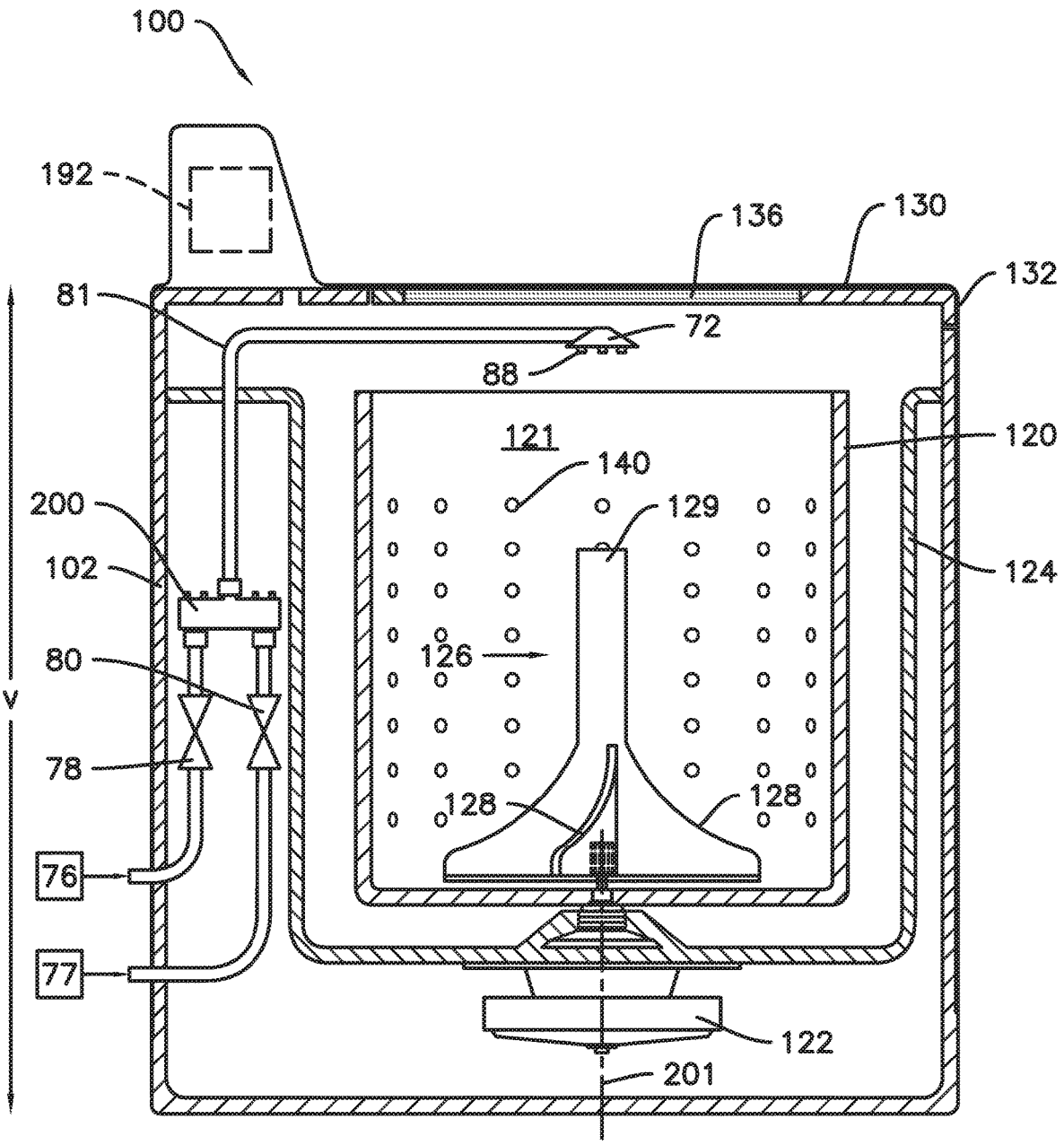
FIG. 3 provides a side cutaway view of the exemplary washing machine appliance of FIG. 1.

FIG. 3 provides a side cutaway view of the exemplary washing machine appliance 100. As shown in FIG. 3, the washing machine appliance 100 may include a tub 124 non-rotatably mounted within the cabinet 102 and a wash basket 120 rotatably mounted within the tub 124. A motor 122, e.g., such as a pancake motor, is in mechanical communication with wash basket 120 to selectively rotate wash basket 120 and/or an agitator feature positioned therein (e.g., during an agitation or a rinse cycle of washing machine appliance 100). Wash basket 120 may define one or more agitator features such as an impeller to assist in agitation and cleaning of articles disposed within wash basket 120 during operation of washing machine appliance 100. For example, as illustrated in FIG. 3, an agitator element 126 includes a plurality of ribs 128 which extend within basket 120 and are circumferentially disposed around a shaft 129. Wash basket 120 may also define a plurality of perforations 140 in order to facilitate fluid communication between an interior, e.g., wash chamber 121, of basket 120 and wash tub 124. In particular, in the example embodiment illustrated by FIG. 3, basket 120 is rotatable about a central axis 201 and the central axis 201 is oriented generally along or parallel to the vertical direction V. Accordingly, the washing machine appliance 100 may be referred to as a vertical axis washing machine. As mentioned above, the illustrated vertical axis washing machine 100 is provided by way of example only.

Embodiments of the present disclosure may also include, e.g., a horizontal axis washing machine as is generally understood in the art.

Operation of washing machine appliance 100 is controlled by a controller or processing device 192 (FIG. 3) that is operatively coupled to control panel 110 for user manipulation to select washing machine cycles and features. In response to user manipulation of control panel 110, the controller 192 operates the various components of washing machine appliance 100 to execute selected machine cycles and features. Controller 192 may further be operatively coupled to various other components of appliance 100, such as various valves, one or more sensors such as a pressure sensor, a speed sensor, temperature sensors, and/or other suitable sensors, etc.

Controller 192 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 192 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100 may be in communication with controller 192 via one or more signal lines or shared communication busses.

In an illustrative embodiment, laundry items may be loaded into wash chamber 121 through aperture 105, and washing operation may be initiated through operator manipulation of input selectors 112. Wash basket 120 (and/or wash tub 124 shown in FIG. 3) may be filled with water and detergent to form a wash fluid. One or more valves, e.g., valves 78 and 80, can be controlled by washing machine appliance 100 to provide for filling wash basket 120 to the appropriate level for the amount of articles being washed. Once wash basket 120 is properly filled with fluid, the contents of wash chamber 121 are agitated for cleansing of laundry items in wash basket 120. For example, the agitation element 126 and/or basket 120 may be moved back and forth in an oscillatory motion.

After the agitation phase of the wash cycle is completed, wash basket 120 may be drained. Laundry articles can then be rinsed by again adding fluid to wash basket 120 and, depending on the particulars of the cleaning cycle selected by a user, the agitation element or impeller may again provide agitation within wash chamber 121. One or more spin cycles may also be used. In particular, a spin cycle may be applied after the wash cycle and/or after the rinse cycle in order to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash chamber 121 through aperture 105.

Wash tub 124 is configured for containing fluid, e.g., wash and rinse fluids, during operation of washing machine appliance 100 described above. Wash fluid generally includes water mixed with fluid additives, e.g., detergent, fabric softener, and/or bleach. As used herein, the terms "additive" or "fluid additive" generally refer to fluids other than water, such as detergent, bleach, fabric softener and/or other such laundry treatment chemicals. Wash and rinse fluids disposed within wash tub 124 can be used to clean articles disposed in wash basket 120. Wash and rinse fluids can pass between wash basket 120 and wash tub 124 through a plurality of apertures 140 defined by wash basket 120, e.g., during the wash and/or spin cycles described above.

Various valves may regulate the flow of fluid into and through washing machine appliance 100 from a first water source 76 and a second water source 77, e.g., first water source 76 may include one or more fluid lines, pipes, conduits, etc. which provide hot water to washing machine appliance 100, e.g., from a residential water heater (not shown) and second water source 77 may include one or more fluid lines, pipes, conduits, etc. which provide cold water to washing machine appliance 100. For example, a hot water valve 78 and a cold water valve 80 may be positioned in such fluid lines to flow hot water and cold water, respectively, to washing machine appliance 100.

Referring still to FIG. 3, each valve 78, 80 may be selectively adjusted between an open position allowing a flow of fluid therethrough and a closed position terminating or obstructing the flow of fluid therethrough. Hot water valve 78 may be in fluid communication with hot water source 76, which may be external to the washing machine appliance 100. Similarly, cold water valve 80 may be in fluid communication with cold water source 77, which may also be external to the washing machine appliance 100. The cold water source 77 may, for example, be a commercial water supply, while the hot water source 76 may be, for example, a water heater appliance.

A spout 72 is configured for flowing a liquid into one or both of tub 124 and basket 120. In particular, for this embodiment, spout 72 is positioned at or adjacent to basket 120 and above the basket 120. Spout 72 is in fluid communication with a water source, or more specifically is fluidly connected to the hot water source 76 and the cold water source 77, in order to direct liquid (e.g., water) into tub 124 and/or onto articles within chamber 121 of basket 120. Spout 72 includes apertures 88 through which water may be sprayed into the tub 124. Apertures 88 may, for example, be tubes extending from the spout 72 as illustrated, or alternatively, apertures 88 may be holes defined in the spout 72. In yet other embodiments, apertures 88 may be any other suitable openings through which water may be sprayed. Further, spout 72 may additionally include other openings, holes, etc. (not shown) through which water may be flowed, i.e., sprayed or poured, into the tub 124 and/or basket 120.

Various valves may regulate the flow of fluid through spout 72 via a supply line 81. For this embodiment, hot water valve 78 and a cold water valve 80 are positioned upstream of a valve manifold 200 to flow hot water and cold water, respectively, through the manifold 200 and to the supply line 81 fluidly connecting the water sources 76, 77 to spout 72. As used herein, the term "supply line" is used to refer generally to the one or more fluid lines, pipes, conduits, etc. provided between water sources 76, 77 and spout 72 of washing machine appliance 100.

Figure 4:
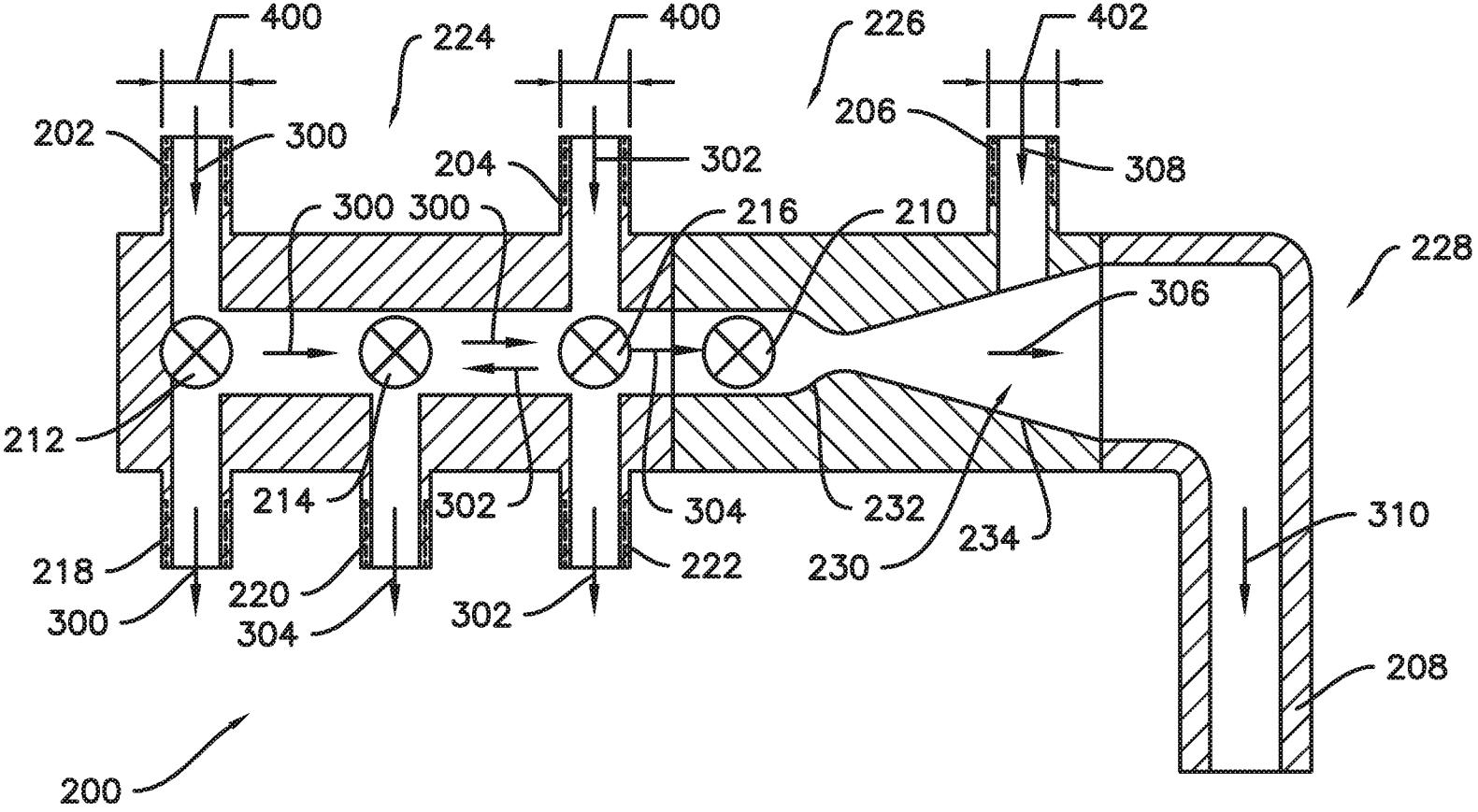
FIG. 4 provides a schematic illustration of a valve manifold for a washing machine appliance such as the exemplary washing machine appliance of FIG. 1 according to one or more exemplary embodiments of the present disclosure.
Figure 5:
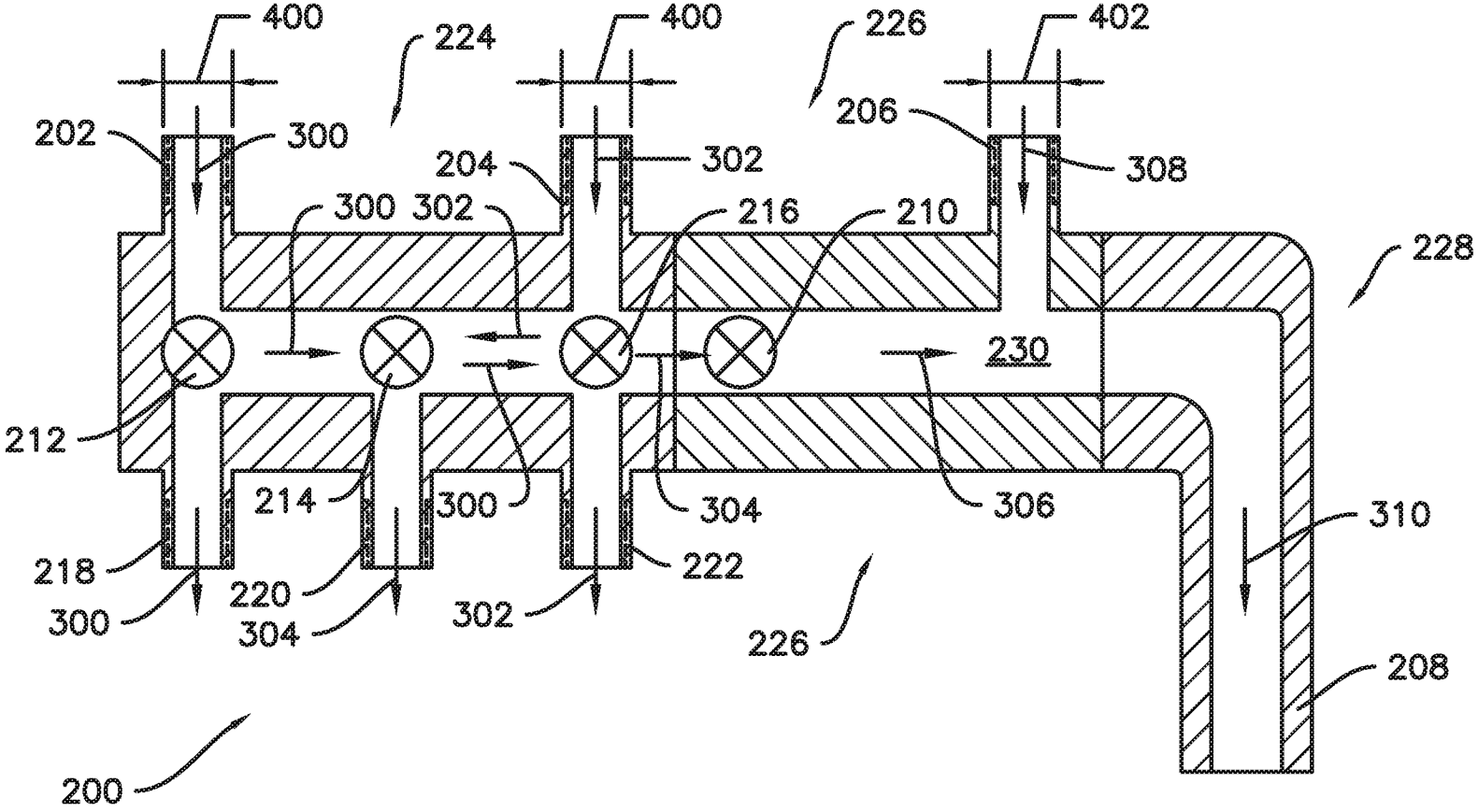
FIG. 5 provides a schematic illustration of a valve manifold for a washing machine appliance such as the exemplary washing machine appliance of FIG. 1 according to one or more additional exemplary embodiments of the present disclosure.
Figure 6:
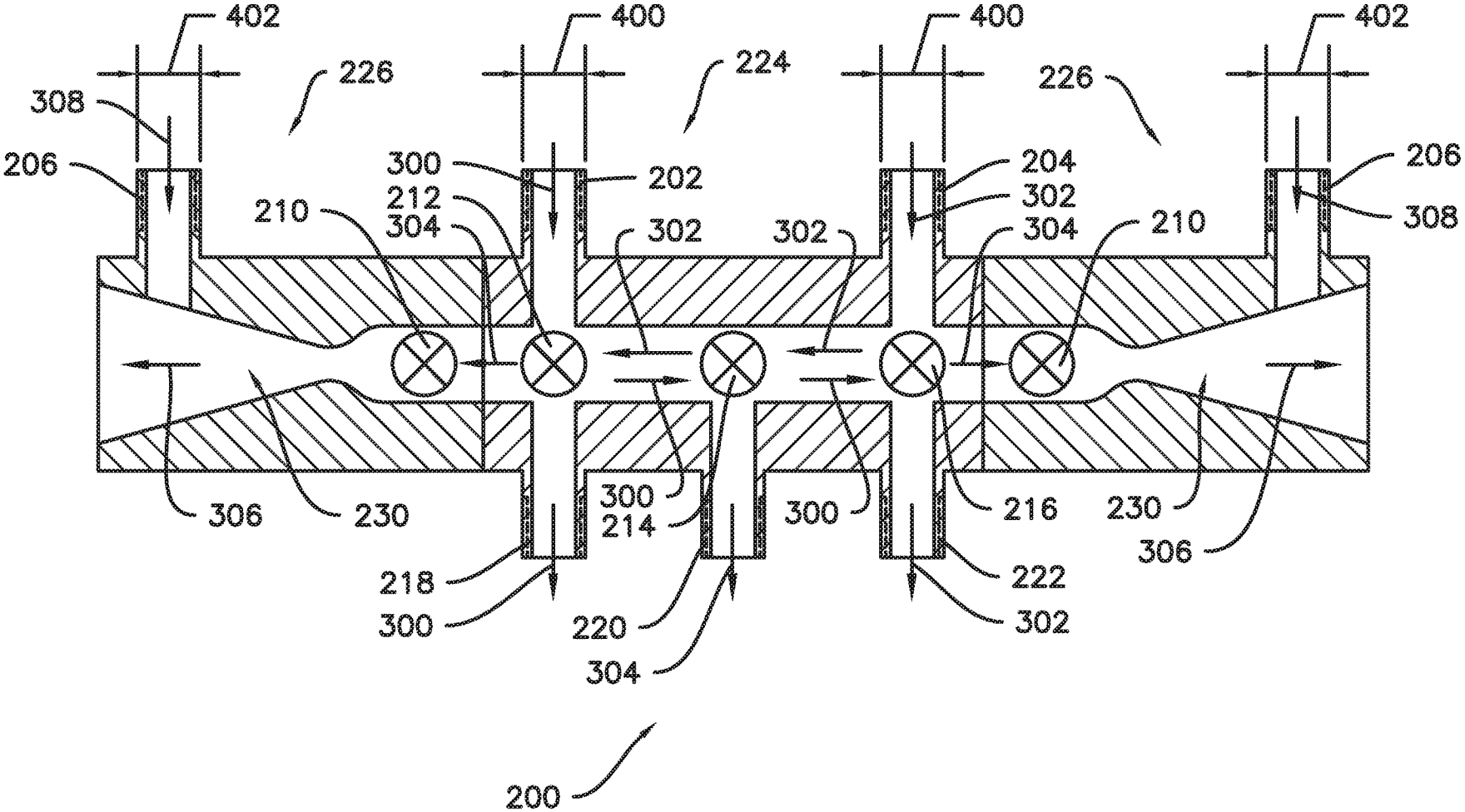
FIG. 6 provides a schematic illustration of a valve manifold for a washing machine appliance such as the exemplary washing machine appliance of FIG. 1 according to one or more further additional exemplary embodiments of the present disclosure.

As illustrated in FIGS. 4 through 6, the valve manifold 200 includes one or more inlet ports integrally formed with the valve manifold 200. For example, the inlet ports may be threaded, such as externally threaded, for connecting to conduits to provide fluid communication to the valve manifold 200. Some example embodiments of the valve manifold 200 may include a first inlet port 202 configured to fluidly connect to the first water source 76. As mentioned above, the first water source may be, e.g., a hot water source. For example, the first inlet port 202 may be fluidly connected to the first water source 76 by one or more tubes, conduits, etc. which extend from the first water source 76 to the valve manifold 200. The valve manifold 200 may further include a second inlet port 204 configured to fluidly connect to the second water source 77, e.g., a cold water source and an auxiliary inlet port 206 configured to fluidly connect to an auxiliary fluid source (not shown) which is external to the washing machine appliance 100. Similar to the first inlet port 202, the second inlet port 204 may be fluidly connected to the second water source 77 and the auxiliary inlet port 206 may be fluidly connected to the auxiliary fluid source.

In various embodiments, examples of which will be described in more detail below, the valve manifold 200 may include one or more than one auxiliary inlet ports 206. The auxiliary inlet port(s) 206 may be configured to connect, e.g., fluidly connect, to various hoses or other conduits. For example, the auxiliary inlet port 206 may be externally threaded and may be sized as a universal connector such that standard size hoses can be connected with valve manifold 200. The external threads may, for example, be formed of a plastic material. For example, the auxiliary inlet port 206 may be sized as a universal connector in that an outer diameter 402 of the auxiliary port 206 may be sized for compatibility with common hose connectors. For instance, in some exemplary embodiments, auxiliary inlet port 206 may include a threaded connector configured to, e.g., sized to, receive a hose connector of a hose having about a ⅝ inch inner diameter, e.g., external threads on the auxiliary inlet port 206 having an outer diameter suitable for mating with internal threads on the ⅝ inch inner diameter of the hose. In other exemplary embodiments, auxiliary inlet port 206 may include a threaded connector sized (e.g., by an outer diameter of the auxiliary inlet port 206) to receive a hose connector of a hose having about a ¾ inch inner diameter. In yet other exemplary embodiments, auxiliary inlet port 206 may include a threaded connector sized to receive a hose connector of a hose having about a ½ inch inner diameter. In yet further exemplary embodiments, auxiliary inlet port 206 may include a threaded connector sized to receive a hose connector of a hose having about a ⅜ inch inner diameter. In some embodiments, the outer diameter 402 of the externally threaded auxiliary inlet port 206 may be the same or substantially the same as an outer diameter 400 of the first and second inlet ports 202 and 204. In other embodiments, the auxiliary inlet port 206 may be geometrically distinct from the first inlet port 202 and the second inlet port 204. For example, the auxiliary inlet port 206 may be geometrically distinct from the first inlet port 202 and the second inlet port 204 in that each of the first inlet port 202 and the second inlet port 204 may have a first outer diameter 400 and the auxiliary inlet port 206 may have a second outer diameter 402 which is different from the first outer diameter 400. Such embodiments which include an auxiliary inlet port 206 geometrically distinct from the first inlet port 202 and the second inlet port 204 may prevent or reduce misconnections, e.g., inadvertent connection of a water line to the auxiliary port 206.

The auxiliary fluid source may be a reservoir, tank, bucket or other container having one or more fluid additives therein. The auxiliary fluid source may, in some embodiments, be pressurized, e.g., a pump may be provided to urge the fluid additive to the valve manifold 200, such as from a pressurized fluid additive line external to the washing machine appliance 100. In such embodiments, the pump or other pressure source which urges the fluid additive through the fluid additive line external to the washing machine appliance 100 is also external to the washing machine appliance 100. For example, in a setting where multiple washing machine appliances 100 may be used in close proximity to one another, e.g., in a hotel or laundromat, a pressurized fluid additive line (e.g., a pipeline, conduit, etc.) may flow through the setting, e.g., laundromat, outside of the washing machine appliances 100 to provide a pressurized auxiliary fluid source for on-demand provision of fluid additive to one or more selected appliances of the multiple washing machine appliance 100 in the, e.g., laundromat.

Still referring generally to FIGS. 4 through 6, the valve manifold 200 may also include one or more outlet ports integrally formed with the valve manifold 200. In some embodiments, the valve manifold 200 may include an auxiliary outlet port 208 downstream of the auxiliary inlet port 206 and an auxiliary valve 210 downstream of the first inlet port 202 and the second inlet port 204. The auxiliary valve 210 may also be upstream of the auxiliary inlet 206. In such embodiments, the auxiliary valve 210 may be positioned and configured to selectively provide fluid communication to the auxiliary outlet port 208 from the auxiliary inlet 206 and at least one of the first inlet port 202 and the second inlet port 204.

The valve manifold 200 may be formed of any suitable material. Preferably, valve manifold 200 and its integrally formed ports are formed of a plastic material. For instance, valve manifold 200 can be formed of a thermoset or thermoplastic material. In some embodiments, water valve manifold 200 and its integrally formed ports may be integrally formed as a unitary component. The valve manifold 200 may be manufactured via any suitable process. For instance, in some embodiments, valve manifold 200 and its integrally formed ports are injection molded to form the unitary manifold component. In other example embodiments, the valve manifold may include a main body 224, an extension 226 and an elbow 228 which are separately formed and integrally joined. For example, the main body 224, the extension 226 and the elbow 228 may each be injection molded separately and may be integrally joined by welding, such as spin welding. In some embodiments, valve manifold 200 and its integrally formed ports may be additively manufactured to form the unitary manifold component. Various combinations of the foregoing examples are also possible. For instance, one or more parts may be additively manufactured and other parts may be injection molded and such parts may then be integrally joined, e.g., welded. Integrally forming and/or integrally joining the valve manifold 200 as described reduces the number of components of valve manifold 200 and makes manufacturing of valve manifold 200 more efficient and cost effective.

As shown in FIGS. 4 through 6, the flow of fluid through valve manifold 200 is controlled by a plurality of valves, e.g., solenoid valves, which may be actuated by controller 192 (FIG. 3). In other embodiments, at least one of the valves, e.g., the auxiliary valve 210 may be remotely controlled. For example, in settings including multiple washing machine appliances 100, e.g., a laundromat as described above, each auxiliary valve 210 of each washing machine appliance 100 may be remotely controlled by a single centralized control to selectively provide a flow, e.g., of fluid additive, to one or more selected washing machine appliances 100 of the plurality of washing machine appliance 100. In embodiments where the valves are locally controlled, e.g., by controller 192, the controller 192 may be operatively coupled with the valves in electrical communication such that the controller can actuate the actuators, e.g., via solenoids, of one or more of the valves in the valve manifold 200 to selectively control flow of fluid through the manifold 200. The internal actuators of valve manifold 200 can be any suitable type of actuator, including e.g., plunger actuators, pivoted-armature actuators, rocker actuators, etc.

As may be seen in FIGS. 4 through 6, the valve manifold 200 may include a first valve 212 immediately downstream of the first inlet port 202, e.g., the first valve may be a hot water valve 212 in embodiments where the first inlet port 202 is a hot water inlet port 202 connected to a hot water supply. The valve manifold 200 may also include a second valve, e.g., a cold water valve 216 immediately downstream of the second inlet port, e.g., cold water inlet port 204. The hot water valve 212 may be selectively actuable between a variety of positions to alternately permit or obstruct a flow of hot water 300 into the valve manifold 200 via the first inlet port 202 and to direct the flow of hot water 300 within the valve manifold 200 when the flow of hot water 300 is permitted or provided into the valve manifold 200. For example, the hot water valve 212 may permit the flow of hot water 300 into the valve manifold 200 and may selectively direct the flow of hot water 300 to one or more of a first outlet port 218, e.g., a hot water outlet port 218, or a mixing valve 214. Similarly, the cold water valve 216 may be selectively actuable between a variety of positions to alternately permit or obstruct a flow of cold water 302 into the valve manifold 200 via the second inlet port 204 and to direct the flow of cold water 302 within the valve manifold 200 when the flow of cold water 302 is permitted or provided into the valve manifold 200. For example, the cold water valve 216 may permit the flow of cold water 302 into the valve manifold 200 and may selectively direct the flow of cold water 302 to one or more of a second outlet port 222, e.g., a cold water outlet port 222, the mixing valve 214, or the auxiliary valve 210.

The mixing valve 214 may, in a first position, receive the flow of hot water 300 from the hot water valve 212 and the flow of cold water 302 from the cold water valve 216 and direct a flow of mixed or warm water 304 to a warm outlet port 220. The mixing valve 214 may, in a second position, receive the flow of hot water 300 from the hot water valve 212 and the direct the flow of hot water 300 to the cold water valve 216. When the mixing valve 214 is in the second position, the cold water valve 216 may be actuated to a first auxiliary position or a second auxiliary position. When the mixing valve 214 is in the second position and the cold water valve 216 is actuated to the first auxiliary position, the cold water valve 216 receives the hot water 300 from the mixing valve 214 and also permits cold water 302 to flow into the valve manifold 200 at cold water inlet port 206, such that the cold water valve 216 directs a mixed or warm flow 304 to the auxiliary valve 310. When the mixing valve 214 is in the second position and the cold water valve 216 is actuated to the second auxiliary position, the cold water valve 216 receives the hot water 300 from the mixing valve 214 and prevents or obstructs cold water 302 from flowing into the valve manifold 200 at cold water inlet port 206, such that the cold water valve 216 directs a flow of hot water 300 to the auxiliary valve 310. Additionally, when the cold water valve 216 in the first auxiliary position, a flow of cold water 302 may instead be directed to the auxiliary valve 210, depending on the position of the mixing valve 214 and/or the hot water valve 212, e.g., when the hot water valve 212 prevents or obstructs the flow of hot water 300 from entering the valve manifold 200 at the hot water inlet port 202 or directs the flow of hot water 300 to the hot water outlet port 218. The description herein of the structure and operation of the valves is by way of example only, in other embodiments of the present disclosure, the valve manifold 200 may include various combinations of some or all of the features described. For example, additional valves and/or additional outlet ports may be included in various combinations such that hot, warm, and/or cold water may be selectively provided directly to the wash basket 120 and/or wash tub 124 and/or may be used to form a wash fluid 310 in the valve manifold 200.

As may be seen for example in FIGS. 4 and 5, in various embodiments, the valve manifold 200 may include a mixing passage 230 upstream of the auxiliary outlet 208 and downstream of the auxiliary valve 210. Within the mixing passage 230, a flow of water 306 and a flow of a fluid additive 308 mix to provide a wash fluid 310, e.g., a mixture of water 306 and additive 308. The wash fluid 310 exits valve manifold 200 via the auxiliary outlet 208 and may then flow into wash basket 120. In such a manner, a fluid additive from a storage container, e.g., a reservoir, external to the washing machine appliance 100 may be dispensed into wash basket 120. In the illustrated embodiment, the water 306 which flows into the mixing passage 230 is a flow of mixed water 304, as noted in FIGS. 4 through 6. In other configurations, e.g., based on the positions of the valves 212, 214, and 216, the water 306 may be hot water 300 or cold water 302.

In some embodiments, for example, as illustrated in FIG. 4, the mixing passage 230 may include a venturi section, e.g., the mixing passage 230 may include a converging section 232 and a diverging section 234. Turning specifically to FIG. 4 and the example venturi section embodiment illustrated therein, as will be recognized by those of skill in the art, a flow of water 306 through the venturi section, e.g., in serial flow order, from auxiliary valve 210 through converging section 232 and diverging section 234 to auxiliary outlet port 208, may provide a motive fluid to draw fluid, e.g., fluid additives 308, into the valve manifold 200 via the auxiliary inlet port 206. As the flow of water 306 enters converging section 232 of the mixing passage 203, the flow of water 306 may increase in velocity and decrease in pressure. Subsequently, as the flow of water 306 passes from converging section 232 of mixing passage 203 into the diverging section 234 of the mixing passage 203, the flow of water 306 may increase in pressure and decrease in velocity. Accordingly, the change in pressure of the flow of water 306 through the mixing passage 230 may assist with drawing a fluid additive 308, e.g., detergent, fabric softener, and/or perfume, into the valve manifold 200 via the auxiliary inlet 206. For example, the fluid additive 308 may be stored, e.g., in a tank or reservoir, such that the fluid additive 308 is exposed to or contiguous with ambient air about washing machine appliance 100 and the storage container (tank, reservoir, etc.) may be fluidly connected to the valve manifold 200 via the auxiliary inlet port 206 which opens into the venturi section of the mixing passage 230 (e.g., converging section 232 of mixing passage 230 or diverging section 234 of mixing passage 230) such that a pressure of fluid at the inlet port 206 into the valve manifold 200 is less than the pressure of the additive within the storage container. In exemplary embodiments, e.g., as illustrated in FIG. 4, converging section 232 is downstream of the auxiliary valve 210, diverging section 234 is downstream of the converging section 232, and the auxiliary inlet port 206 opens into the diverging section 234. Thus, the mixing passage 230 may pump additive 308, e.g., detergent, into the valve manifold via auxiliary inlet port 206 when the flow of water 306 passes through the mixing passage 230.

As another example, in some embodiments, e.g., as illustrated in FIG. 5, the mixing passage 230 may include a constant cross-section. In such embodiments, the auxiliary inlet port 206 may be configured to fluidly connect to a pressurized fluid source, such as a pressurized fluid additive line, e.g., in a laundromat, as described above.

In some embodiments, e.g., as illustrated in FIG. 6, the valve manifold 200 may include more than one auxiliary port 206. For example, as shown in FIG. 6, the valve manifold 200 may include a first extension 226, e.g., at the hot water side adjacent the first inlet port 202, with a first auxiliary port 206 provided therein, and a second extension 226, e.g., at the cold water side adjacent the second inlet port 204, with a second auxiliary port 206 provided in the second extension 226. Note that in FIG. 6 the elbows 228 are omitted for the sake of clarity of illustration, nevertheless it is to be understood that a first and second elbow 228 may be provided, including first and second auxiliary outlets 208 thereon, similar to the elbows 228 illustrated in FIGS. 4 and 5. In the example embodiment illustrated by FIG. 6, the first and second extensions 226 each include a mixing passage 230 having a venturi section, similar to the mixing passage 230 illustrated in FIG. 4. In other embodiments which include more than one mixing passage 230, some or all of the mixing passages 230 may instead have a constant cross-section, e.g., as illustrated in FIG. 5.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:
- a cabinet;
- a tub positioned within the cabinet;
- a basket rotatably mounted within the tub, the basket defining a wash chamber for receipt of articles for washing; and
- a valve manifold comprising:
  - a first inlet port configured to fluidly connect to a first water source;
  - a second inlet port configured to fluidly connect to a second water source;
  - a first auxiliary inlet port adjacent the first inlet port and configured to fluidly connect to an auxiliary fluid source;
  - a first auxiliary outlet downstream of the first auxiliary inlet port;
  - a second auxiliary inlet port adjacent the second inlet port;
  - a second auxiliary outlet downstream of the second auxiliary inlet port; and
  - an auxiliary valve downstream of the first inlet port and the second inlet port and upstream of the first auxiliary inlet port, the first auxiliary valve configured to selectively provide fluid communication from the first auxiliary inlet port and at least one of the first inlet port and the second inlet port to the first auxiliary outlet.

2. The washing machine appliance of claim 1, wherein the valve manifold comprises a mixing passage upstream of the first auxiliary outlet and downstream of the auxiliary valve.

3. The washing machine appliance of claim 2, wherein the mixing passage comprises a venturi section.

4. The washing machine appliance of claim 2, wherein the mixing passage has a constant cross-section.

5. The washing machine appliance of claim 4, wherein the first auxiliary inlet port is configured to fluidly connect to a pressurized fluid source.

6. The washing machine appliance of claim 1, wherein the valve manifold comprises a first valve directly downstream of the first inlet port, a second valve directly downstream of the second inlet port, and a mixing valve downstream of the first valve and the second valve.

7. The washing machine appliance of claim 1, wherein the auxiliary valve is a solenoid valve.

8. The washing machine appliance of claim 1, wherein the first auxiliary inlet port and the second auxiliary inlet port are each geometrically distinct from the first inlet port and the second inlet port.

9. The washing machine appliance of claim 1, wherein each of the first inlet port and the second inlet port comprises a first outer diameter and each of the first auxiliary inlet port and the second auxiliary inlet port comprises a second outer diameter different from the first outer diameter.

10. A valve manifold for a washing machine appliance, comprising:
- a first inlet port configured to fluidly connect to a first water source;
- a second inlet port configured to fluidly connect to a second water source;
- a first auxiliary inlet port adjacent the first inlet port and configured to fluidly connect to an auxiliary fluid source;
- a first auxiliary outlet downstream of the first auxiliary inlet port;
- a second auxiliary inlet port adjacent the second inlet port;
- a second auxiliary outlet downstream of the second auxiliary inlet port; and
- an auxiliary valve downstream of the first inlet port and the second inlet port and upstream of the first auxiliary inlet port, the auxiliary valve configured to selectively provide fluid communication from the first auxiliary inlet port and at least one of the first inlet port and the second inlet port to the first auxiliary outlet.

11. The valve manifold of claim 10, further comprising a mixing passage upstream of the first auxiliary outlet and downstream of the auxiliary valve.

12. The valve manifold of claim 11, wherein the mixing passage comprises a venturi section.

13. The valve manifold of claim 11, wherein the mixing passage has a constant cross-section.

14. The valve manifold of claim 13, wherein the first auxiliary inlet port is configured to fluidly connect to a pressurized fluid source.

15. The valve manifold of claim 10, further comprising a first valve directly downstream of the first inlet port, a second valve directly downstream of the second inlet port, and a mixing valve downstream of the first valve and the second valve.

16. The valve manifold of claim 10, wherein the auxiliary valve is a solenoid valve.

17. The valve manifold of claim 10, wherein the first auxiliary inlet port and the second auxiliary inlet port are each geometrically distinct from the first inlet port and the second inlet port.

18. The valve manifold of claim 10, wherein each of the first inlet port and the second inlet port comprises a first outer diameter and each of the first auxiliary inlet port and the second auxiliary inlet port comprises a second outer diameter different from the first outer diameter.

19. A washing machine appliance comprising:

a cabinet;

a tub positioned within the cabinet;

a basket rotatably mounted within the tub, the basket defining a wash chamber for receipt of articles for washing; and a valve manifold comprising:

a first inlet port configured to fluidly connect to a first water source;

a second inlet port configured to fluidly connect to a second water source;

an auxiliary inlet port configured to fluidly connect to an auxiliary fluid source;

an auxiliary outlet downstream of the auxiliary inlet port;

an auxiliary valve downstream of the first inlet port and the second inlet port and upstream of the auxiliary inlet port, the auxiliary valve configured to selectively provide fluid communication from the auxiliary inlet port and at least one of the first inlet port and the second inlet port to the auxiliary outlet; and a mixing passage upstream of the auxiliary outlet and downstream of the auxiliary valve, the mixing passage comprising a venturi section.

20. The washing machine appliance of claim 19, wherein the auxiliary inlet port is geometrically distinct from the first inlet port and the second inlet port.

* * * * *